United States Patent [19]

Manhart

[11] 3,983,956

[45] Oct. 5, 1976

[54] NOISE REDUCTION BARRIER

[76] Inventor: J. Kenneth Manhart, 516 El Medio Ave., Pacific Palisades, Calif. 90272

[22] Filed: Nov. 4, 1974

[21] Appl. No.: 520,239

[52] U.S. Cl. ..... 181/33 G; 181/33 HE; 256/13.1

[51] Int. Cl.[2] ..... E04B 1/99

[58] Field of Search ..... 256/13.1, 19, 24, 73; 52/144, 145, 244, 300, 404, 578–580, 613, 615; 181/33 G, 33 HE

[56] References Cited

UNITED STATES PATENTS

| | | | |
|---|---|---|---|
| 2,753,962 | 7/1956 | McBerty | 52/300 X |
| 3,630,310 | 12/1971 | Federer | 181/33 HE X |
| 3,656,576 | 4/1972 | Gubela | 181/33 HE X |
| 3,804,196 | 4/1974 | Horn et al. | 181/33 G |
| 3,846,949 | 11/1974 | Okawa | 181/33 G X |
| 3,856,268 | 12/1974 | Fitch | 256/13.1 |
| 3,867,995 | 2/1975 | Sanders | 181/33 G |

*Primary Examiner*—John Gonzales
*Attorney, Agent, or Firm*—Buckles and Bramblett

[57] ABSTRACT

A noise reduction barrier is formed by connecting together a plurality of prefabricated vertically oriented panel members so configured that a hollow tubular wall is formed between opposed panels. The space between panels is filled with sand or loose earth which provides the mass to make the structure sound retardant. In alternative embodiments, for increased sound absorption, perforated sheet material may be secured to the outer edges of the barrier wall and the interstices filled with rock wool or similar porous material.

5 Claims, 14 Drawing Figures

Fig. 3.
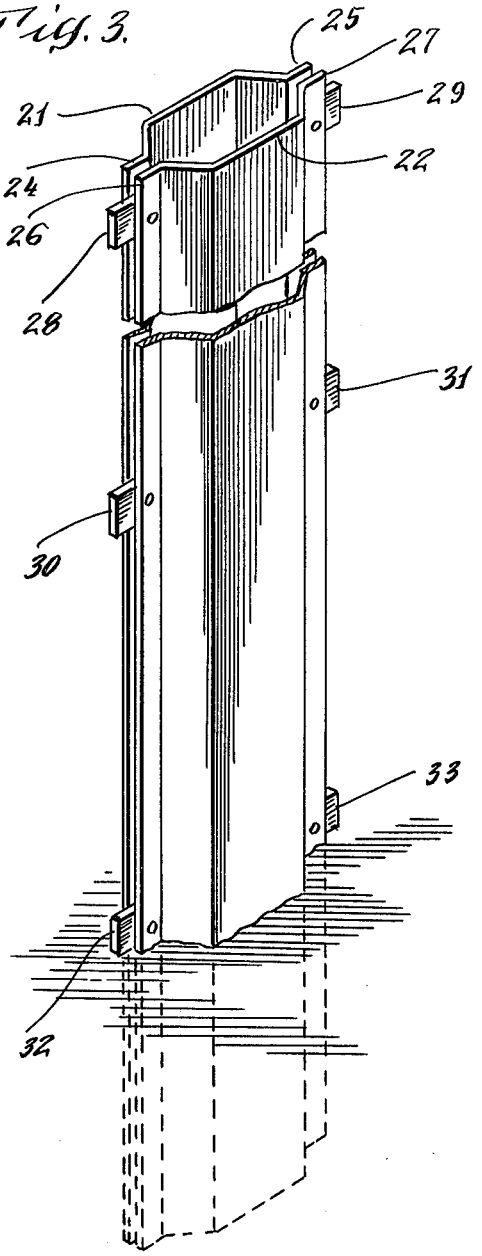
Fig. 4.
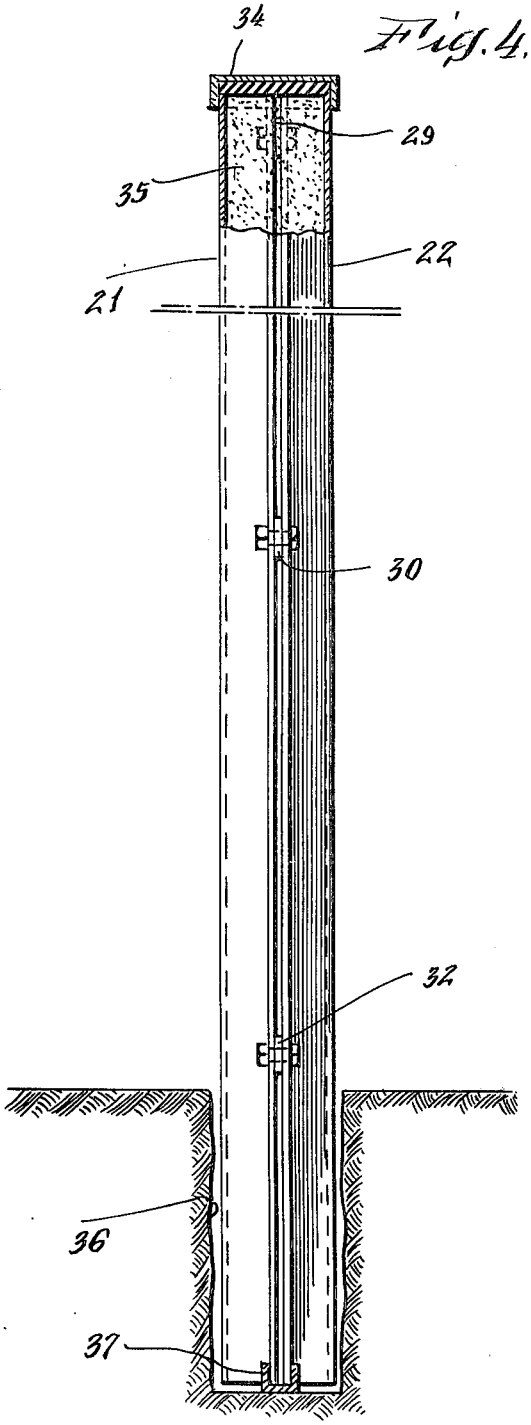
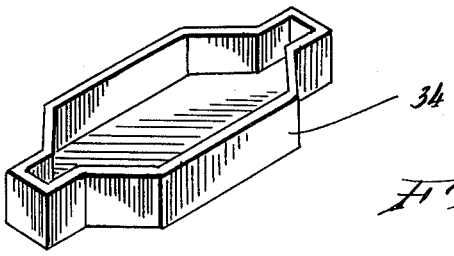
Fig. 5.

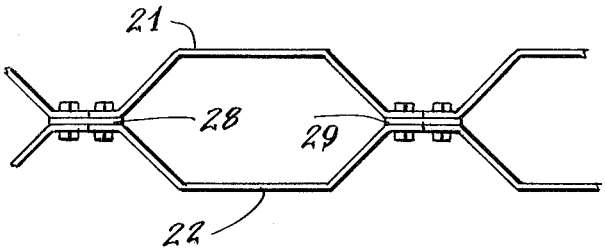
Fig. 6.
Fig. 7.
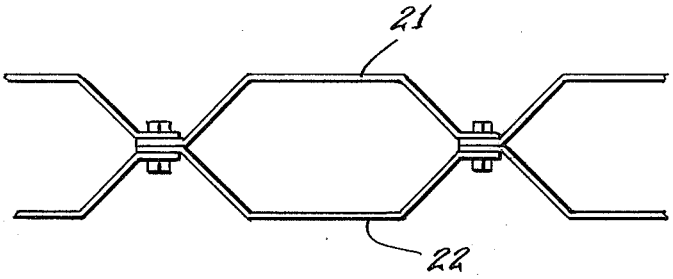
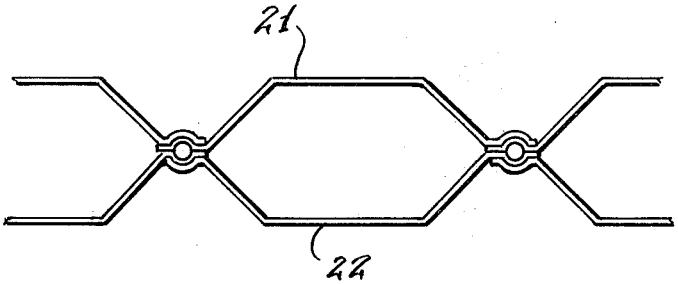
Fig. 8.
Fig. 9.
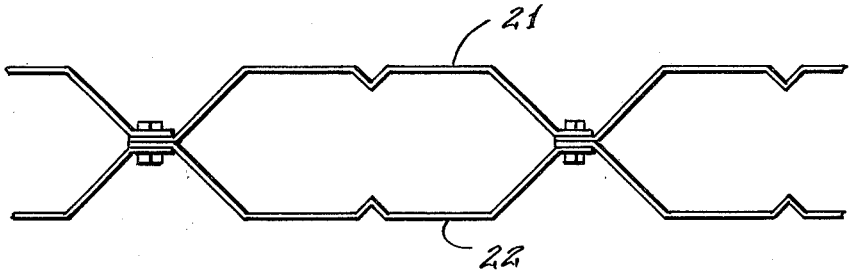
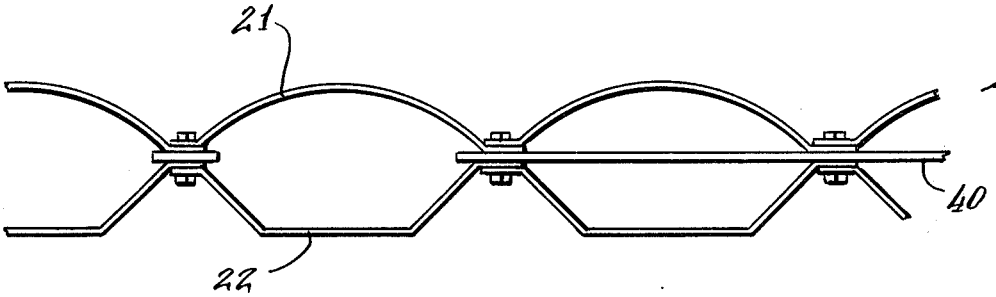
Fig. 10.
Fig. 11
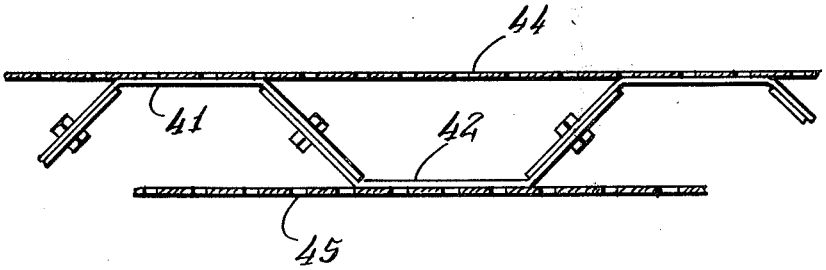

NOISE REDUCTION BARRIER

The foregoing abstract is not to be taken either as a complete exposition or as a limitation of the present invention. In order to understand the full nature and extent of the technical disclosure of this application, reference must be had to the following detailed description and the accompanying drawings as well as to the claims.

BACKROUND OF THE INVENTION

Federal and State legislative bodies have recognized the widespread problem of traffic noise in adjacent communities and the result has been the establishment of mandatory noise control measures for existing and future highways. To meet the traffic noise levels that are compatible with different land uses requires substantial noise abatement efforts on a large number of highways.

One method of achieving lower community noise levels is by the use of a noise reduction barrier. Such a barrier attenuates noise by preventing the direct propagation of noise between the noise source and the listener, and also, in many cases, by absorbing the sound energy incident upon the surface of the barrier. Barriers are applicable to the design of new highways and are an attractive means of providing noise relief to communities along existing highways.

There are four primary requirements for an acceptable highway noise barrier:

a. it must function effectively as a noise reduction structure b. the barrier must be a safe roadside structure c. the total installation costs must be acceptable, and d. the barrier must have an acceptable appearance.

SUMMARY OF THE INVENTION

The present invention relates to noise reduction barriers that are useful in reducing the level of industrial, motor vehicle or other obtrusive noise in neighboring communities or in specific locations involving social activities such as patios or tennis courts. The barrier uses the concept of transmission loss and, where desired, sound absorptive surfaces to achieve noise abatement.

In accordance with one form of the present invention, a three dimensional panel is fabricated of lightweight structural materials and erected in a modular format as a series or a plurality of vertical ducts or tubes which constitute a continuous barrier. The ducts are fabricated of impervious materials and assembled so that they can retain inexpensive solid or liquid fill material adequate to achieve design noise reduction.

Using structural materials that are non-corrosive or have corrosive resistant coatings for metallic modules, the lower ends of the ducts are inserted into a trench dug in the ground. The earth removed to make the trench may be used to refill the trench both within and outside of the duct. Other alternatives include the use of sand, gravel, cement or closed cell high-density foam to embed the modules. Thus, the portion of the duct projecting into the ground provides its own foundation; the depth of the embedment is dependent upon the type of soil and the design wind load conditions.

The ability of a barrier to reduce noise levels in specific areas, depends upon a number of variables including geometrical factors such as the relative heights and distances of the noise source and receiver to the barrier, and the impervious mass per unit area (i.e., surface density) of a wall type barrier. While there will be a frequency dependent upper limit to noise reduction that can be achieved by a wall type barrier (due primarily because the sound can reach the receiver only by diffraction around the boundaries of the barrier), in general, the greater the surface density of the barrier, the greater its transmission loss (TL). It is important that the barrier have sufficient mass so that the sound energy transmitted through the barrier will be negligible to that diffracted over or around the barrier.

One method of predicting the transmission loss (TL) of a wall in the mass controlled region is provided by the expression:

$$TL = 20 \log_{10} f + 20 \log_{10} W - 33, \text{ dB.}$$

where $f$ = frequency of sound, Hz, and $W$ = barrier surface density, lbs/ft$^2$ The TL being a function of frequency and surface density of the barrier.

Basically, the transmission loss is the net reduction in the level of sound energy transmitted through (not diffracted around) the barrier. The greater the transmission loss, the less sound energy passes through the barrier. The transmission loss is dependent upon the surface density, the stiffness and degree of damping of the wall, the frequency spectra of the sound and other factors.

Generally, the noise reduction is described in terms of dBA because of the close relationship of the dBA scale to public evaluation of annoyance. In addition, most noise Federal and State legislation use the dBA scale as their annoyance criteria. Basically, dBA scale means that the frequency spectra of noise is weighted to account for the change in sensitivity of the ear with frequency. Thus, the A-weighted noise reduction will vary as the spectrum of the sound source changes. My calculations indicate the need for a barrier to have a minimum surface density or weight of about 4 lbs/sq ft.

OBJECTS OF THE INVENTION

A principal object of the invention is to provide an economical and effective means for reducing the level of noise along highways adjacent inhabited land.

A more specific object of the invention is to provide a sound barrier constructed of a plurality of uniform lightweight elements which are readily mass produced.

A further object of the invention is to provide such a noise reduction barrier which may be erected with a minimum of labor and material expense.

Other objects of the invention will in part be obvious and will in part appear hereinafter.

The invention accordingly comprises the features of construction, combination of elements, and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings in which:

BRIEF DESCRIPTION OF THE DRAWINGS

FIG. 3 is a perspective view of one assembled module of the invention;

FIG. 4 is a vertical cross-sectional view of the module shown in FIG. 3;

FIG. 5 is a perspective view of one form of module cap suitable for use with the structure of the invention;

FIG. 6 is a top plan view illustrating a perferred manner of interconnecting a plurality of modules as shown in FIG. 3;

FIG. 7 is a top plan view illustrating an alternative mode of interconnecting modules;

FIG. 8 is a top plan view of yet another mode for interconnecting modules to form a barrier;

FIG. 9 is a top plan view of a slightly different form of module;

FIG. 10 is a top plan view of another barrier configuration illustrating how panels of different shapes may be combined for esthetic purposes;

FIG. 11 is a top plan view of yet another barrier configuration which may be employed either with or without exterior sheeting to contain sound absorbent materials;

DETAILED DESCRIPTION

Figure 1:
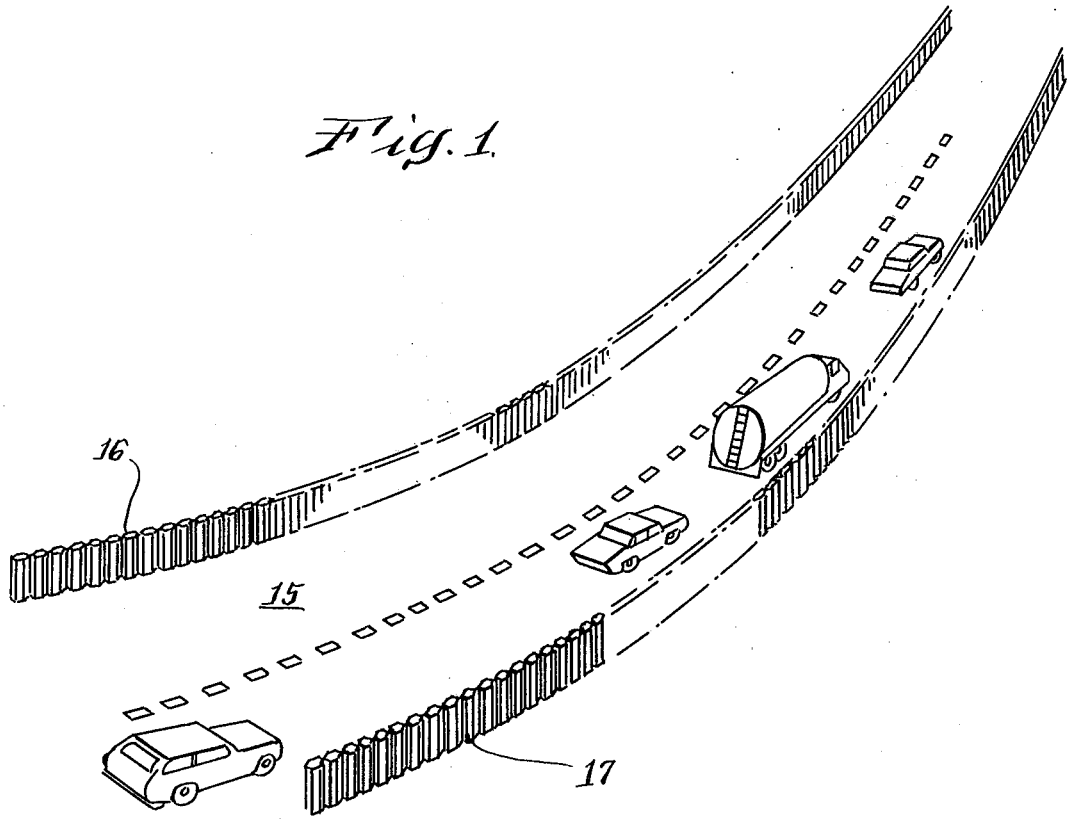
FIG. 1 is a perspective view showing a noise reduction barrier according to the invention erected alongside a busy highway.

Referring first to FIG. 1 of the drawings, a busy roadway indicated generally at 15 has erected along either side thereof sound barriers 16 and 17. As suggested above, the barriers 16 and 17 are preferably sound absorbent on the side facing traffic rather than sound reflectant; they must be of sufficient height to prevent direct radiation of sound from the highway noise sources, i.e., the moving vehicles, into the adjacent community alongside the roadway; they must be sufficiently durable to withstand weather and wind, yet they should be sufficiently frangible to breakaway under the impact of a vehicular collision.

Figure 2:
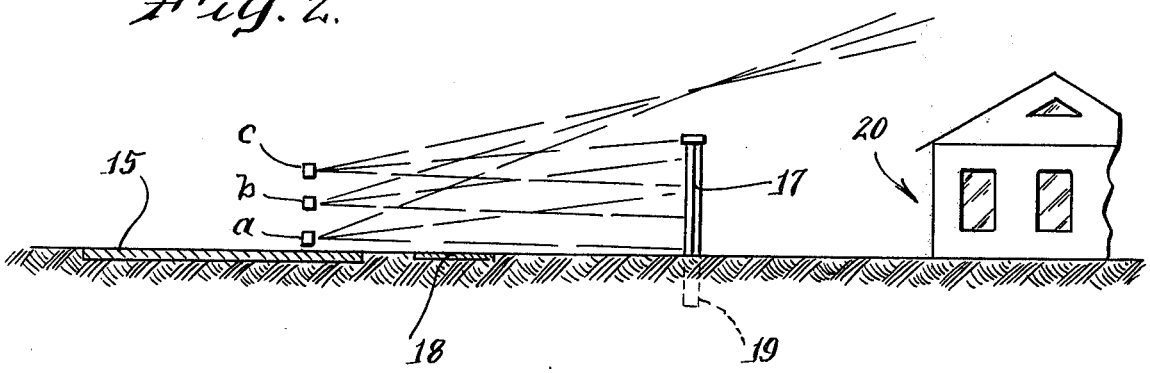
FIG. 2 is a vertical schematic view illustrating how the sound barrier of the invention is effective.

Reference is now had to FIG. 2 of the drawings which is a vertical view, partly in cross-section, which illustrates how the sound barrier 17 erected beyond the emergency lane 18 of roadway 15 bars the intrusion of highway noise into an adjacent residential area indicated generally at 20. The lower end of vertical barrier 17 is buried in the ground at 19, thereby providing its own foundation. Vehicular generated noise along roadway 15 is indicated as originating from three sources, *a*, *b* and *c;* with a representing noise coming from near the roadway surface, i.e., tire and pavement interaction noise; *b* representing noise originating 2 to 4 feet above the pavement, mostly aerodynamic, engine, gear and/or horn noise; and *c* representing elevated noise such as emitted from a diesel exhaust stack. The lines shown radiating from the point sources *a*, *b* and *c* in FIG. 2 represent the direct, straight-line, transmission of noise. The "shadow" area to the right of barrier 17 in FIG. 2 illustrates the zone in which highway noise has been abated by the presence of the sound barrier.

Referring now to FIG. 3 of the drawings, a preferred embodiment of sound barrier module according to the invention is shown to comprise two identically formed three-dimensional panel members 21 and 22, each having parallel outer flange portions 24-25 and 26-27 respectively. The flanges 24-26 and 25-27 are fastened to the opposite faces of horizontally extending spacer members 28-29, 30-31, and 32-33 by suitable means such as bolts, rivets or welding. The module thus assembled is structurally rigid and ready for imbeding in the ground, as shown by the lower portion in broken lines of FIG. 3.

FIG. 4, the upper portion of which is cut away in cross-section, illustrates how the hollow spece between panel walls 21 and 22 and flanges is filled with inert sound deadening material. In the most economical and practical construction the space 35 is filled with loose earth removed in digging the narrow trench 36 in which the lower end of the barrier is installed. Additional earth fill, or sand as required, may be readily installed at the contruction site. To facilitate alignment of adjacent panel modules which are fastened to the protruding spacer members 28-29, 30-31 and 32-33, and to construct a uniform linear barrier according to the invention, I employ a guide channel 37 which is laid in the bottom center of the trench 36 and into which the lower ends of all the connected modules are fitted before the trench 36 is filled with earth or concrete. To prevent the entry of rain or snow into the interior space between the assembled modules, a cap 34 shown in perspective detail in FIG. 5 is placed over each module after filling. The cap 34 may be formed of injection molded plastic, or it may be stamped or diecast from light metal.

FIG. 6 is a top plan view showing the connection of adjacent modules of the type illustrated more fully in FIGS. 3 and FIG. 4. FIGS. 7 and 8 are also top plan views of a portion of an assembled barrier, illustrating alternative methods of interconnecting modules. FIG. 9 is another top plan view of interconnected barrier modules formed of panels having a slightly different surface configuration and a greater volumetric capacity for sound retardant fill.

FIG. 10 is a top plan view showing how opposed panel members of different configurations may be employed for esthetic considerations. FIG. 10 also illustrates how a continuous horizontal spacer bar 40 may be employed for greater structural rigidity as may be required if the module panel members are formed of lightweight plastic material, or if exceptionally high wind loads may be encountered. It may also be a solid sheet to provide the minimum mass required for adequate transmission loss in lieu of sand or earthen fill.

Figure 12:
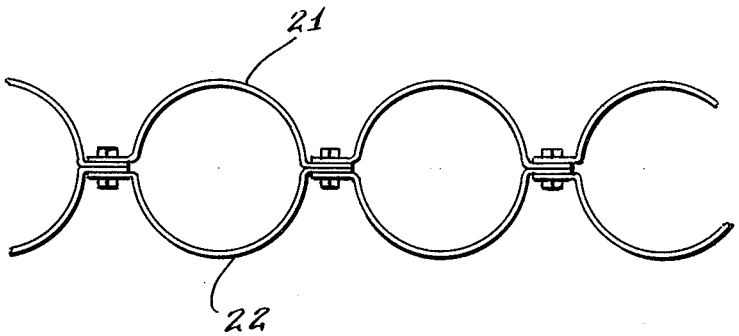
FIG. 12 is another top plan view of a modified barrier construction in which the modules are of substantially semicircular cross-section.
Figure 13:
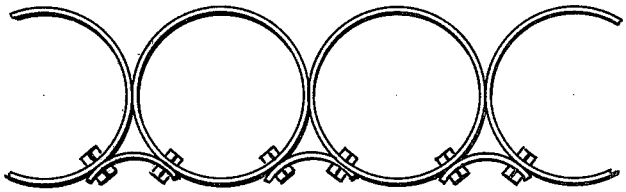
FIG. 13 is a top plan view of another arrangement in which hollow cylindrical posts are mounted in adjacent linear abutment and interconnected to form a sound barrier.

FIG. 11 is a top plan view of an alternative embodiment of modular sound barrier construction wherein alternating single panel members such as 41 and 42 may be interconnected and have affixed to their outer planar surfaces perforated sheeting, which may be of plastic, metal, fiberboard, etc. FIG. 12 is another top plan view of an alternative embodiment wherein opposed semicylindrical panels are edge connected together to form substantially cylindrical vertical chambers for receiving earth fill or other material to achieve the necessary surface density. FIG. 13 is a top plan view similar to FIG. 12 by showing how extruded tubular members may be connected together in a vertical row for the construction of a sound barrier according to the invention.

Figure 14:
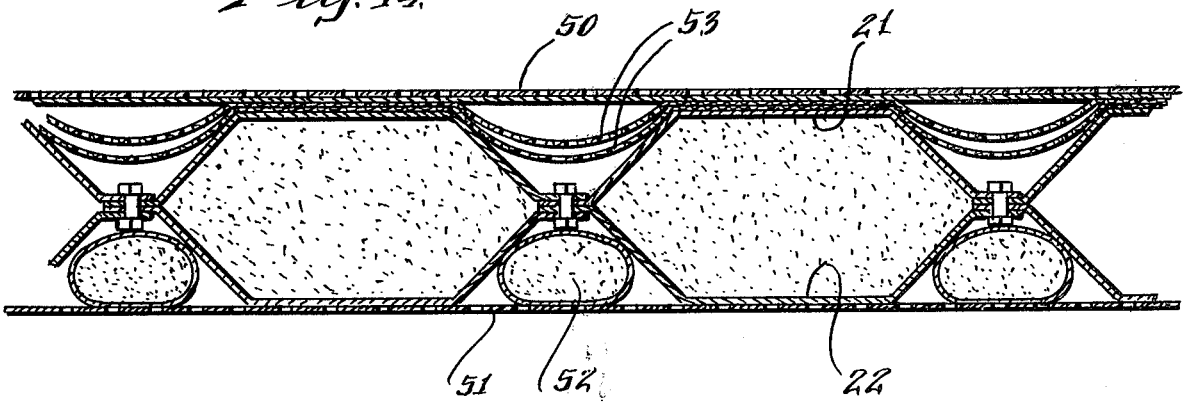
FIG. 14 is a top plan view of yet another barrier construction adapted for maximum sound absorption and minimum noise transmission.

FIG. 14 represents a top plan view of an alternative embodiment wherein the basic trapezoidal modules support perforated plates 50 and 51 over their outer surfaces, and wherein bulk sound absorbing material 52, such as fiberglass or rock wool, is wrapped in a thin moisture impervious membrane, such as polyethylene, and inserted between the flutes of the modules and the exterior perforated plates as shown. Thin permeable sheets 53 may also be used behind the perforated sheet to make that surface sound absorptive. The perforations in plates 50 and 51 must occupy a minimum of at least 23% of the surface area, in order that the covering serve as a sound absorber and not as a reflector. This embodiment provides maximum sound absorption and the mass of the barrier provides for sound attenuation.

With the present invention the surface density of the sound barrier necessary to attain the desired noise reduction is achieved by spacing the front and rear surfaces of the structural modules apart during erection of the barrier and then filling the void between them with earth, sand and gravel, or liquid. Thus the spacer elements 28-29, 30-31, and 32-33 shown in FIG. 3 of the drawings may be made thicker to construct a barrier with greater mass and to achieve a higher degree of noise abatement. The barrier modules may be fabricated of translucent plastic material and the assembled structure may be filled with clear liquid (such as water and anti-freeze) for use in locations where shadow effects might otherwise offer road hazards such as distraction, poor visibility, or the retention of ice, snow or moisture on the road surface. The use of non-metallic materials for the barrier modules also results in a structure that is non-magnetic and transparent to TV, radio and radar signals.

Thus it will be apparent that the modular shells employed in the construction of a noise reduction barrier according to the present invention can be lightweight, and can be fabricated in a form which nests during shipment to the site, thereby reducing transportation costs of the unassembled barrier. The lightweight modules are easy to handle and simple to erect, thereby reducing labor costs, and the fill material can be blown or poured into the upright ducts after the barrier is emplaced. The use of inexpensive sand as fill results in a structure that is highly damped and non-resonant at any frequency.

While the invention has been described as employed for highway noise abatement, it will be understood that is can also be employed to achieve acoustical privacy from extraneous sources in localized area such as in a back yard, a tennis court, around construction equipment, a playground or the like.

It will thus be seen that the object set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention which, as a matter of language, might be said to fall therebetween.

Having described my invention, what I claim as new and desire to secure by Letters Patent is:

1. A noise reduction barrier comprising in combination, a plurality of vertically orientated tubular shell members, each of said shell members having one end thereof embedded in the ground and each said member joined along a vertical line to a corresponding adjacent member whereby all of said members form a contiguous linear array, and sufficient sound retardant material filling the space within and between the shells of said members to provide a mass of at least 4 pounds per square foot of exposed area, and means for retaining said material between said shells.

2. The combination of claim 1 wherein said sound retardant material is selected from the group consisting of earth, sand, gravel and water.

3. The combination of claim 1 including a weather impervious cover member affixed to the exposed top ends of said tubular shell members.

4. A noise reduction barrier comprising in combination, a plurality of vertically oriented tubular shell members, each of said shell members having one end thereof embedded in the ground and each said member joined along a vertical line to a corresponding adjacent member whereby all of said members form a contiguous linear array, sufficient sound retardant material filling the space within and between the shells of said members to provide a mass of at least four pounds per square foot of exposed area, and a weather resistant perforated sheet of planar material affixed to the outer surfaces of said linear tubular array, wherein the perforations constitute at least twenty three percent of the surface area of said sheet material.

5. The combination of claim 4 wherein sound absorbent fiberous material is inserted into the interstices between said tubular members and said perforated sheet.

* * * * *